United States Patent [19]

Adams

[11] Patent Number: 5,058,503

[45] Date of Patent: Oct. 22, 1991

[54] AERODYNAMIC PROJECTILE

[76] Inventor: John Q. Adams III, 3385 John Adams Rd., Willow Spring, N.C. 27592

[21] Appl. No.: 204,532

[22] Filed: Jun. 9, 1988

Related U.S. Application Data

[63] Continuation-in-part of Ser. No. 40,025, Apr. 20, 1987, abandoned.

[51] Int. Cl.[5] ..... F42B 10/00

[52] U.S. Cl. ..... 102/501; 102/439

[58] Field of Search ..... 102/439, 501, 514–519, 102/524, 525, 513

[56] References Cited

U.S. PATENT DOCUMENTS

| | | | |
|---|---|---|---|
| 6,973 | 12/1849 | Jenning | 102/501 |
| 137,442 | 4/1873 | Haycock | 102/524 |
| 1,072,880 | 9/1913 | Teves | 102/501 |
| 1,518,920 | 12/1924 | Halloran | 102/439 |
| 4,109,581 | 8/1978 | Six | 102/501 |
| 4,282,670 | 8/1981 | Junker | 102/513 |
| 4,572,077 | 2/1986 | Antoine et al. | 102/501 |
| 4,610,205 | 9/1986 | Bentley | 102/501 |
| 4,836,108 | 6/1989 | Kegel et al. | 102/517 |

FOREIGN PATENT DOCUMENTS

| | | | |
|---|---|---|---|
| 2919358 | 12/1979 | Fed. Rep. of Germany | 102/501 |
| 321003 | 6/1935 | Italy | 102/501 |
| 483983 | 4/1938 | United Kingdom | 102/517 |

*Primary Examiner*—Harold J. Tudor

*Attorney, Agent, or Firm*—Rhodes, Coats & Bennett

[57] ABSTRACT

The present invention pertains to a solid projectile having identical tapered leading and trailing sections that are integral with and which extend from opposite ends of a central bearing section having a constant diameter throughout its length.

8 Claims, 2 Drawing Sheets

AERODYNAMIC PROJECTILE

This is a continuation in part application of U.S. Pat. application filed on Apr. 20, 1987, with Ser. No. 07/040,025 now abandoned.

FIELD OF THE INVENTION

The present invention relates to projectiles and more particularly to projectiles of the type fired by a gun and more particularly to a solid projectile that is designed for improved accuracy and range.

BACKGROUND OF THE INVENTION

Over the years there has been many attempts at improving the basic design of bullets. For a general understanding and appreciation of bullet design one is referred to the disclosures found in the following U.S. Pat. Nos. 4,455,942; 726,291; 55,796; and 1,075,202.

With the great interest that exists in the sport target shooting and with the interest of hunters and outdoorsman, attention has been given to developing bullet designs that yield greater accuracy and range. However, for the most part, little progress in these areas have been made over the years.

Besides improved accuracy and range there are other performance characteristics of bullets that deserve and which have received attention. For example, the reduction or minimization of recoil is an important consideration because recoil can substantially affect accuracy not to mention any discomfort that maybe associated with recoil. Again even though recoil is a very prominent and undesirable characteristic of fired bullet there has been little research and design effort actually placed in effectively reducing or minimizing recoil.

Closely tied to accuracy and range is the concern for increasing the velocity of a projectile or bullet for a given charge. Increasing the velocity of the bullet as well as reducing the drag of the bullet depends very much on the aerodynamic qualities of the bullet itself. The same can be said for the other performance characteristics of accuracy, range, etc., discussed above. Again, little real progress has been made at improving the aerodynamic qualities of a bullet. In fact for the most part the "boat shaped" bullet remains one of the principal standards, if not the principal standard, design in the ammunition industry. Yet the "boat shaped" bullet is not a highly efficient and effective aerodynamic design. Therefore, there has been and continues to be a great need for an improved bullet design that incorporates aerodynamic principals that will effectively yield a bullet design with improved performance characteristics.

SUMMARY AND OBJECTS OF THE INVENTION

The present invention relates to an improved bullet or projectile design that incorporates and utilizes aerodynamic principles to improve accuracy, range, velocity, drag resistance, and recoil characteristics along with other performance characteristics.

In particular, the bullet design of the present invention contemplates a solid projectile (made of steel, brass, or the like) that includes a central cylindrical section that has a constant diameter throughout its entire length. Integrally formed on each end of the cylindrical section and extending forwardly therefrom are identically shaped and tapered leading and trailing end sections. Each end section is tapered from the central section to a point such that the diameter progressively decreases. This imparts a balanced aerodynamic shape to the bullet structure. As a result of that design, accuracy and range is improved, recoil is minimized and the velocity of the bullet for a given charge is increased.

It is therefore a principal object of the present invention to improve the overall structural design of a projectile or bullet.

Another object of the present invention resides in the provision of a bullet design that incorporates aerodynamic principles to improve operating and performance characteristics of the bullet.

Still a further object of the present invention resides in the provision of a balanced aerodynamic design for a bullet that increases both accuracy and range of the bullet.

Another object of the present invention resides in the provision of bullet design that results in decreasing the drag of the bullet as it moves through the air.

Another object of the present invention resides in the provision of a bullet design that is specifically designed to fire more efficiently within a fire arm and which is especially designed to counter the normal factors that give rise to recoil upon firing so as to ultimately reduce recoil for a given size bullet and charge.

A further object of the present invention is to provide a solid bullet design made of steel or brass.

Also an object of the present invention is to provide a solid steel bullet design that will effectively make a fire arm more accurate by "cleaning" or "smoothing" irregularities from the barrel.

Other objects and advantages of the present invention will become apparent and obvious from a study of the following description and the accompanying drawings which are merely illustrative of such invention.

DETAILED DESCRIPTION OF THE INVENTION

Figure 1:
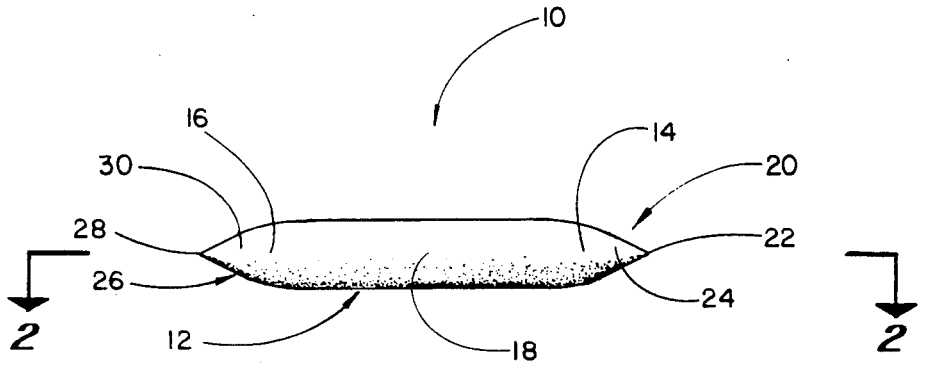
FIG. 1 is a side elevational view of a first species of the bullet or projectile of the present invention.

With reference to the drawings, the aerodynamic bullet of the present invention is shown therein and indicated generally by the numeral 10. Bullet 10 is completely solid and is preferably constructed of steel or brass or a like material.

Viewing bullet 10 in detail, it is seen that the same includes a central cylindrical section indicated generally by the numeral 12. Central section 12 includes opposite end areas 14 and 16 and a cylindrical surface 18. It is important to stress that the central cylindrical section 12 includes a smooth cylindrical surface 18 and that entire central section 12 is of a constant and unchanged diameter throughout its entire length.

Central cylindrical section 12 forms the bearing surface of bullet 10, that is that surfaces that engages the inner wall of the gun barrel as it moves therethrough after firing. Central section 12 is of at least 3/16 of an inch in length.

Intergrally formed with the central cylindrical section 12 is a forward or leading section indicated generally by the numeral 20. Leading section 20 includes a forward point 22 and a tapered surface 24. It is noted that the tapered surface 24 extend from end area 14 of the central section 12 to point 22. Tapered surface 24, as shown in the drawings, is of such a design that the cross-sectional area of the leading section 20 progressively decreases from the end area 14 towards the point 22.

Integrally formed with the central section 12 about the end area 16 is a trailing section indicated generally by the numeral 26. Trailing section 26 would be identical in design and shape as the leading section 20. Trailing section 26, as seen in the drawings, includes a rearward point 28 and a tapered surface 30. Tapered surface 30 extends from the end area 16 of central section 12 to point 28. As with leading section 20, tapered surface 30 results in the diameter of the trailing section becoming progressively smaller from end area 16 to point 28.

Figure 2:
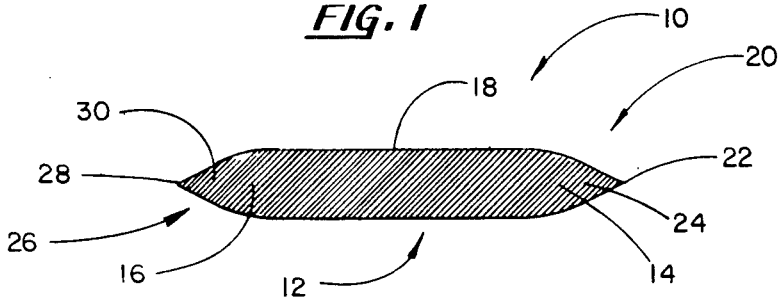
FIG. 2 is a longitudinal sectional view of the bullet shown in FIG. 1.
Figure 3:
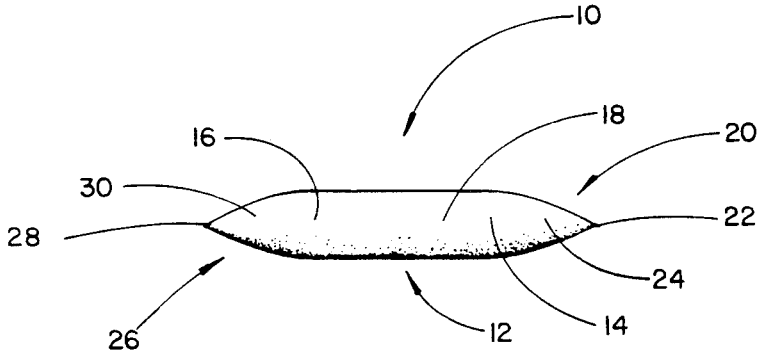
FIG. 3 is a side elevational view of a second species of the bullet of the present invention.
Figure 4:
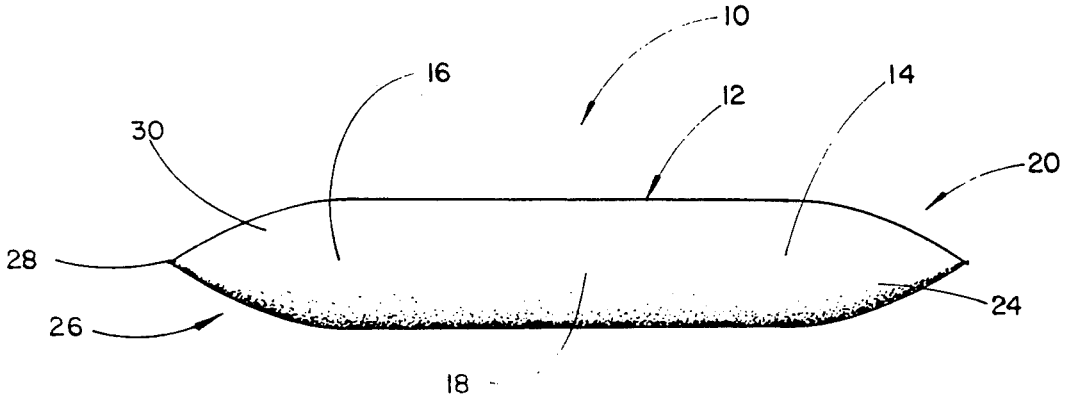
FIG. 4 is an enlarged side elevational view of the bullet or projectile of the present invention showing basic aerodynamic features of the bullet.

Turning to FIGS. 1–3, there is shown two species of the aerodynamic bullet 10. These two species only differ in the arrangement and degree of taper for the leading and trailing sections 20 and 26. For example, in FIG. 3, a first species is shown and therein the tapered surface 24 for the leading section 20 is of a relatively large arcuate shape. That is the tapered surface 24 extends in an arcuate path from the end area 14 of the central section to point 22. This makes for relatively long leading and trailing sections. Again it should be pointed out for any particular bullet !0, the leading and trailing sections 20 and 26 respectively would be identical in design.

Now turning to the second species, as shown in FIGS. 1 and 2, it is seen that the tapered section, includes a dual or split tapered surface. First, the tapered surface that extends outwardly from a respective end area 14 or 16 of the central section 12 is of a relatively small arcuate shape as contrasted to the arcuate shape of the first species discussed above. As seen in the drawings, this relatively small arcuate shaped taper results in the cross-sectional area of that particular section decreasing from the respective end area of the central section 12 towards the outer or remote point. In this second species, the taper of the particular end section is not uniform and constant throughout the length of the particular section. More particularly in this second species, as seen in FIGS. 1 and 2, there is a break in the taper intermediately between its ends or between the central section 12 and its point. In particularly, in the second species, from the relatively small arcuate shaped taper, the taper changes to a generally straight line taper to the respective point.

In tests conducted, a fixed brass solid bullet had an increased velocity of more than 310 feet per second as compared with a conventional bullet haveing an equal weight and the same powder charge. This increased velocity represented approximately a 10% increase in projectile velocity.

The shape and design of the bullet 10 contributes to the increased velocity. In addition, the solid hard material comprising the bullet 10 and the bearing surface of the central section 12 also contributes to th increased velocity of the bullet 10. Specifically, the hardness of the bullet 10 and its substantial cylindrical barrel bearing surface tends to confine and efficiently direct the point of explosion against the bullet causing it to be propelled or fired from the barrel with increased thrust. More particularly, the hardness of the bullet 10 and its confinement within the barrel of a particular firearm tend to confine the thrust of the explosion to the area around the trailing section 26. In other words, energy from the explosion is confined and not permitted to move forwardly pass the central section 12.

Recoil is also minimized by the present design. Because of the substantial bearing surface of the central section 12 and the relatively hard brass or steel material from which the bullet 10 is constructed, the bullet itself tends to engage the inner cylindrical wall of the barrel when the same is fired thereby tending to move the barrel forward with the explosion. Thus the recoil attributed to the explosion is effectively countered.

In addition, as already pointed out, the present aerodynamic design yields a totally symetrical and balanced bullet design which contributes to its increased range and accuracy as well as presenting a design that minimizes drag. The continuous smooth and uninterrupted surface of the bullet 10 assures that air will flow thereover in a streamline fashion as the bullet flies through the air.

In addition, recoil is reduced or minimized due to the shape of the trailing section 26. In particular because of the pointed and tapered shape of the trailing section 26 the impact force directed against the trailing section 26 tends to be deflected outwardly towards the side and not to be directly repelled as is the case where the conventional bullet design has a blunt or boat shaped trailing end section.

The hard solid steel bullet will also tend to make a fire arm more accurate That is, the hardness of the solid steel bullet along with its bearing surface will tend to "smooth" or "iron out" any rough spots or irregularities in the barrel It is noted that the first and second species of the present invention is made of a relatively hard material such as steel or hard brass. In this application, the phrase relatively hard will refer to a material of hardness similar to steel or hard brass.

Figure 5:
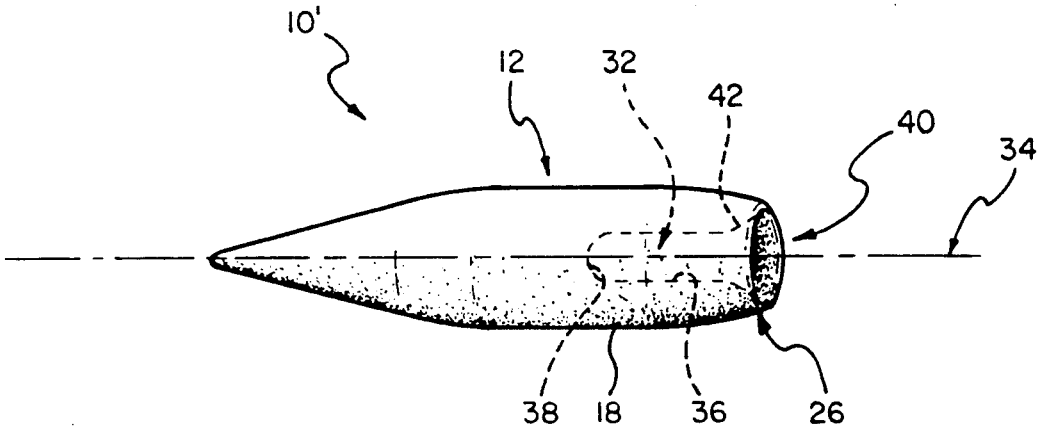
FIG. 5 is a side perspective view of the bullet or projectile of an alternate design of the present invention.
Figure 6:
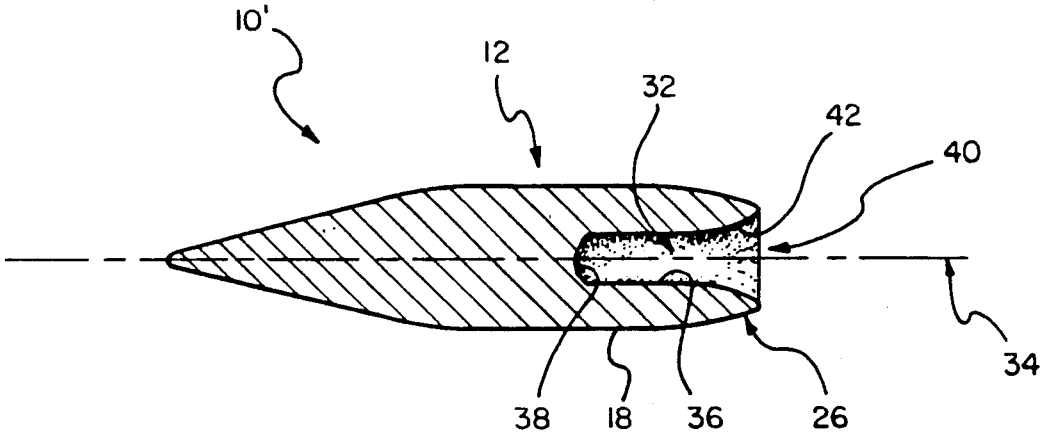
FIG. 6 is a longitudinal cross-sectional view of the alternate design of the present invention.
Figure 7:
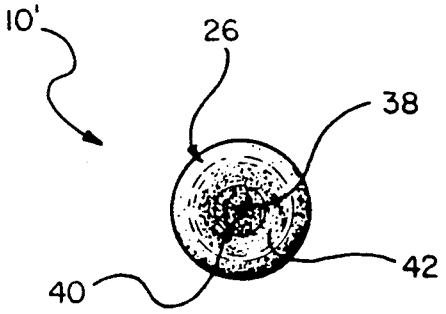
FIG. 7 is a rear end view of the alternate design of the present invention.

An alternate design bullet 10' of the present invention is illustrated in FIGS. 5 and 7 and entails a projectile of a design similar to the species shown in FIG. 1–4. This alternate design projectile includes a cavity 32 extending from central section 12 to and through the trailing section 26. It is noted that the trailing section 26 is truncated inasmuch as the rear point or tip 28 of this section has been removed. Cavity 32 is located coaxially along major axis 34 of the bullet 10'. In more detail, it would seem that the same includes a rear opening 40 that forms the rear terminal and of the projectile 10'. Extending forwardly from the rear opening 40 is a cylindrical internal wall 36. Cylindrical wall 36 is of generally constant diameter and extends through trailing section 26 and into the central section 12. Within the central section 12, the internal side wall 36 terminates at closed end 38. As seen in the drawings, FIGS. 5 and 6, an inner flare ring 42 is formed and serves as a transition between the rear opening 40 in the surrounding internal wall 36.

The cavity 32 functions to stabilize the bullet 10' within the barrel of a gun and thus increases the accuracy of a fired bullet 10'. When bullet 10' is placed within the firing chamber of a gun, the bearing surface 18 on the central section 12 of the bullet 10' fits snugly against the inner surface of the firing chamber, whereas the trailing section 26 of the bullet 10' tapers such that the trailing section 26 does not contact the firing chamber walls and a space is formed between trailing section outer surface and the gun barrel's outer walls. Then when the gun is fired, exploding gases expand both within the firing chamber and within the bullet's cavity 32. Because the trailing section 26 does not make contact with the firing chamber surface, the pressure from the expanding gases is generally equal on both the outer surface and the internal side walls 36 of the trailing section 26, thus causing no significant contraction or expansion of the trailing section 26.

However, due to the relative snug fit of the bearing surface 18 against the firing chamber walls, there is minimal direct outer pressure from the expanding gases on the bearing surface 18 of the central section 12. Therefore, the pressure from the exploding gases within the cavity 32 on side walls 36 causes the portion of the central section 12 surrounding the cavity 32 of the bullet to slightly expand. This expansion forces the corresponding bearing surface 18 against the grooved walls of the gun barrel as the bullet travels through the gun barrel. By wedging or locking a portion of the bearing surface 18 against the gun barrel walls, the bullet 10' is brought into better alignment with the inside walls of the gun barrel, thus decreasing "bullet wobble". With a decrease in bullet instability, the accuracy of the fired bullet 10' is significantly increased.

Additionally, the cavity 32 functions to increase the velocity and range of bullet 10'. First, the cavity 32 reduces the weight of the bullet 10' producing a better length to weight ratio. The improved length to weight ratio of the alternate design bullet 10' gives bullet 10' increased velocity and range as compared to conventional bullets of equal weight. Also, a heavier material can be used in the construction of bullet 10' while still maintaining a favorable length to weight ratio as compared to a bullet of conventional design and lighter construction material. Secondly, the cavity and flare ring of the cavity increases the range and velocity of bullet 10' by creating, in effect, a suction which pulls air off the sides of the bullet towards the cavity's center axis at the rear of the bullet. This suction action, not present in a conventional bullet design, causes the bullet to travel more efficiently through the air to provide greater range without sacrificing accuracy.

From the foregoing specification and discussion it is appreciated that the present invention presents a new aerodynamic design for a projectile or bullet that increases accuracy, range and velocity and which reduces recoil.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A projectile which is expandable within the barrel of a firearm in response to firing, comprising:

a) a cylindrical central section having an outer surface and a generally constant diameter throughout its length;

b) a leading section integrally formed with the central section and projecting forwardly therefrom, the leading section having a forward point an outer tapered surface that tapers uniformly over a substantial area of the section from the cylindrical section to the point;

c) a trailing section integrally formed with the central section and projecting rearwardly therefrom, the trailing section having an outer surface that uniformly tapers inwardly from the central section;

d) an open expansion cavity extending completely through the trailing section and substantially into the central section, and having a rear cavity opening found in the trailing section and a closed surrounding wall extending through both the trailing and the central section, and a closed end wall disposed within the central section, and wherein the expansion cavity is coaxial with respect to the projectile; and e) wherein the firing of the projectile results in the explosive gases moving into the open cavity and into and around the area defined by the barrel and the outer surface of the trailing section, and wherein the trailing section resists expansion due to the existence of substantially equal pressure within the cavity and about the outer surface of the trailing section, but wherein the central section expands due to the pressure on the surrounding walls in that portion of the cavity and the lack of substantial counter gas pressure on the central section surface, thus causing the outer surface of the central section to be forced outwardly against the barrel as the projectile moves through the same, resulting in improved accuracy.

2. The projectile of claim 1 wherein a flare ring is formed in the rear opening of said cavity, such that in a portion of the trailing section the surrounding wall tapers inwardly from the cavity opening.

3. The projectile of claim 1 wherein the cavity is generally cylindrical in shape.

4. The projectile of claim 2 wherein the open cavity includes a forward cavity portion that extends from the end wall rearwardly through the central section and wherein the cross-sectional area of the forward cavity portion is generally constant throughout its length; and wherein the open cavity further includes an arcuate shaped cavity portion.

5. A projectile which is expandable within the barrel of a firearm in response to firing, comprising:

a) a cylindrical central section having an outer surface, first and second ends and a generally constant diameter throughout its length;

b) a leading section integrally formed with said central section and generally tapering forwardly from the first end of said central section to a point;

c) a trailing section integrally formed with said central section and generally tapering rearwardly from the second end of said central section to a cavity opening;

d) an open expansion cavity beginning at said cavity opening and extending through said trailing section and into said cylindrical section, wherein said cavity is completely open and disposed coaxially along a major axis of said trailing and cylindrical section, and wherein said open cavity terminates at an ending wall located within said central section and is surrounded by an inner wall formed within said trailing and central section.

6. The projectile of claim 5 wherein a flare ring is formed in the opening of said cavity, such that in a portion of the trailing section the surrounding wall tapers inwardly from the cavity opening.

7. The projectile of claim 5 wherein the cavity is generally cylindrical in shape.

8. The projectile of claim 6 wherein the open cavity includes a forward cavity portion that extends from the ending wall rearwardly through the central section and wherein the cross-sectional area of the forward cavity portion is generally constant throughout its length; and wherein the open cavity further includes an arcuate shaped cavity portion.

* * * * *